United States Patent [19]

De Weers

[11] Patent Number: 4,958,579

[45] Date of Patent: Sep. 25, 1990

[54] SEWING DEVICE FOR MATTRESSES OR CUSHIONS

[76] Inventor: Antonius M. De Weers, Middenhavenstraat 5, 1976 CK, Ijmuiden, Netherlands

[21] Appl. No.: 314,933

[22] Filed: Feb. 24, 1989

[30] Foreign Application Priority Data

Feb. 26, 1988 [NL] Netherlands ..... 8800505

[51] Int. Cl.[5] ..... D05B 11/00; D05B 21/00

[52] U.S. Cl. ..... 112/2.1; 112/275; 112/272

[58] Field of Search ..... 112/131, 2.1, 2.2, 3 R, 112/3 A, 10, 274, 272, 270, 137, 129, 153, 275

[56] References Cited

U.S. PATENT DOCUMENTS

| | | | |
|---|---|---|---|
| 1,513,090 | 10/1924 | Collett | 112/2.1 |
| 1,947,058 | 2/1934 | Pittoni | 112/2.2 |
| 4,381,719 | 5/1983 | Goldbeck | 112/272 |
| 4,404,919 | 9/1983 | Martell et al. | 112/272 X |
| 4,526,116 | 7/1985 | Mannel | 112/103 X |
| 4,542,707 | 9/1985 | Balzer et al. | 112/131 X |
| 4,722,290 | 2/1988 | Manuel et al. | 112/153 |
| 4,827,858 | 5/1989 | Horie et al. | 112/153 X |
| 4,838,186 | 6/1989 | Resta et al. | 112/2.1 |

FOREIGN PATENT DOCUMENTS

| | | | |
|---|---|---|---|
| 1941423 | 3/1971 | Fed. Rep. of Germany | 112/129 |
| 63-97197 | 4/1988 | Japan | 112/129 |

*Primary Examiner*—Peter Nerbun

*Attorney, Agent, or Firm*—Dennison, Meserole, Pollack & Scheiner

[57] ABSTRACT

A device for sewing the edges of a mattress contains a movable supporting face, a sewing mchine, and a swingable arm cooperating with holding means for swinging the mattress around one of its corners. Furthermore, sensors for sensing the position of the mattress are provided, as well as a control device for activating the swingable arm, dependent on the signals issued by the sensors. The control device also contains counting devices and memory elements for automatically stitching one complete edge of a mattress.

9 Claims, 4 Drawing Sheets

SEWING DEVICE FOR MATTRESSES OR CUSHIONS

The present invention relates to a device for sewing, along the edges of a mattress or cushion, the material covering the top and bottom of the mattress to the material covering the sides of the mattress, provided with a supporting face which is movable for moving the mattress along a sewing machine which has a sewing needle which can be pushed through the mattress material which covers the edge area of the top or bottom and the mattress material which covers the adjacent edge area of the side, which mattress is resting on the supporting face.

Such known sewing devices are operated by a person who stands in the vicinity of the sewing machine next to the supporting table at the side where the mattress with covering material is fed in to the sewing machine. He holds the material to be sewn firmly so that it is sewn up correctly by the sewing machine at the edge of the mattress. At the same time a narrow strip is fed in which is also sewn on and covers the seam as a decoration. When the material covering the mattress is sewn along an edge up to a corner of the mattress, the operating personnel have to stop the sewing machine and possibly the supporting face and swing the mattress through 90° by hand, following which the sewing machine and the supporting face are set in motion again.

These known sewing devices have various disadvantages. First of all, the work load on the operating personnel is great. Not only does the operating person have to ensure that the material which covers the mattress and is to be sewn up is held in the correct position for sewing up, but he must also stop the sewing operation at the corner at the correct moment, and then turn the mattress by hand through 90°. All this has to be carried out with fairly high accuracy, as otherwise the material covering the mattress will not sit correctly against the mattress surface after sewing up. In the case of larger mattresses in particular, the problem occurs that great effort has to be applied to swing the mattress through 90°, which in the long run, because the personnel become tired, has an adverse effect on the accuracy of the sewing operation.

The object of the invention is therefore to produce a device of the type mentioned in the preamble which is simpler to operate, without great exertion. This is achieved according to the invention in that, in the direction of movement of the supporting face beyond the sewing machine, there is a swingable arm which can be swung between a position parallel to and a position essentially perpendicular to said direction of movement, near the swivel point of said arm there is a first sensor for the detection of a hindmost mattress corner in the direction of movement of the supporting face, and holding means for holding the mattress at said corner, the sensor and the drive units for sewing machine, supporting face, holding means and swingable arm being connected to a control device suitable for stopping the sewing machine and supporting face on detection of a corner and for bringing the holding means and the swingable arm into the operating position so that the mattress can be swung through 90° round the held corner, and for subsequently returning the holding means and the swingable arm to the idle position again.

As soon as an edge of the mattress has been sewn with the sewing device according to the invention, the mattress is automatically swung through 90° by the swingable arm. This dispenses with the part of the work of the operating personnel which requires great effort. Besides, the operating person no longer has to watch carefully to see whether the corner of the mattress has been reached, in order to stop the drives, since this takes place automatically. He can therefore concentrate better on feeding in the material covering the mattress in the correct position to the sewing machine, with the result that the accuracy of the sewing operation can be maintained without too much difficulty. Moreover, due to the fact that the mattress is held at the correct place by holding means, it is ensured that when the sewing machine and the supporting face are set in motion again the next edge is sewn from the correct point. It must be ensured here that the turning point of the mattress is precisely at the point of intersection of the sewing seams of adjacent edges. The sewing device can be designed in such a way that the sewing machine and the supporting face can be restarted either automatically or by hand.

Holding means meeting the above-mentioned conditions can be designed in various ways. According to a first possible embodiment, the device has a second sensor for detecting the position of the sewing needle, said second sensor being connected to the control device in such a way that on detection of a mattress corner by the first sensor the sewing needle can be stopped in the extended position and in that position constitutes the holding means for the turning of the mattress. In the case of this design it is always ensured that the turning point of the mattress coincides with the point of intersection of the sewing seams of adjoining mattress edges. Although the sewing needle runs at an angle relative to the surface of the supporting face and therefore intersects the imaginary pivot line of the mattress, this does not constitute any problem because the materials to be sewn and the mattress are supple and the sewing needle runs through these materials for only a short distance.

As already mentioned, the mattresses to be sewn with the sewing device can differ considerably as regards their weight. The same applies to the forces occurring during the swinging of the mattress. In the case of heavy mattresses the problem can occur that the fairly thin sewing needle will be too greatly stressed and will bend. In these cases the sewing needle cannot therefore be used as a holding means, but according to a second possible embodiment provision is made for the holding means to be an extendible and retractable auxiliary needle near the sewing needle, and that a second sensor is fitted to detect the position of the sewing needle connected to the control device, in such a way that on detection of of the mattress corner by the first sensor the sewing needle can be stopped in the retracted position and the auxiliary needle can be brought into the extended position. The auxiliary needle can be made thicker than the sewing needle, so that such an auxiliary needle is also suitable for use as a holding means for heavier mattresses. This auxiliary needle can be placed in such a way that it coincides with the pivot line of the mattress.

According to another embodiment, provision can be made for a third sensor in the direction or movement of the mattress before the sewing machine, which sensor is connected in such a way to the control device that the driving speed of the drive units of sewing machine and supporting face can be reduced gradually on detection of the mattress corner. The advantage of this is that the sewing machine does not stop too abruptly, which is bad for the sewing mechanism. Slowing down the sewing operation at the end of a mattress edge also simplifies the job of the operating personnel, in particular if the operating person still has little experience. The distance along which the slowing-down takes place can be selected at various lengths by fitting the sensor so that it is displaceable in the direction of movement of the mattress.

The drive units of the supporting face and the sewing machine are preferably coupled by means of a synchronization device in such a way that the mattress can be moved in a straight line along the sewing machine. This is because if the speed of movement of the supporting face were, for example, to be lower than that of the sewing machine, the mattress would be pulled crooked, which is of course undesirable. The opposite case, in which the speed of advance of the supporting face is greater than that of the sewing machine, would also give rise to problems.

The supporting face can also be set up at an angle, a guide strip being provided at the low side of the supporting face. With this design it is always ensured that the mattress rests against the guide strip.

In practice, the process of sewing a mattress is such that the start of the sewing seam is set up at any point on an edge between two mattress corners. At the end of the sewing operation of a complete mattress edge the operating person has to watch out for this starting point of the sewing seam, so that the edge in question is fully sewn. On the other hand, it is pointless to sew part of the edge twice. In this respect also it is possible according to the invention to obtain a simplification of the work by providing the control device with a first memory element for storage of a first number of stitches, a second memory element for storage of a second number of stitches, a counting device for counting the corners detected by the first sensor, a counting device for adding or subtracting the stitches for counting the first number of stitches between the first stitch and the first corner, for counting the second number of stitches between the second and the third corner, and for subtracting the stitches from the second number of stitches after detection of the fourth corner, and an element connected to the drive units for comparison of the first and second number and for stopping the drive units if the second number is equal to or smaller than the first number. In this way it is possible to take care of any overlap of the sewing seams by allowing the difference to drop a little to below the number of stitches which were counted for detection of the first corner.

According to a variant, if the sewing speed is constant, the device can be designed in such a way that it is provided with a first memory element for storing a first number of time units, a second memory element for storing a second number of time units, a counting device for counting the corners detected by the first sensor, a counting device for adding or subtracting the time units for counting the first number of time units between the first stitch and the first corner, for counting the second number of time units between the second and the third corner, and for subtracting the time units from the second number of time units after detection of the fourth corner, and an element connected to the drive units for comparing the first and second number and for stopping the drive units if the second number has become equal to or less than the first number.

The invention will now be explained in greater detail below with reference to a number of examples of embodiments.

Figure 1:
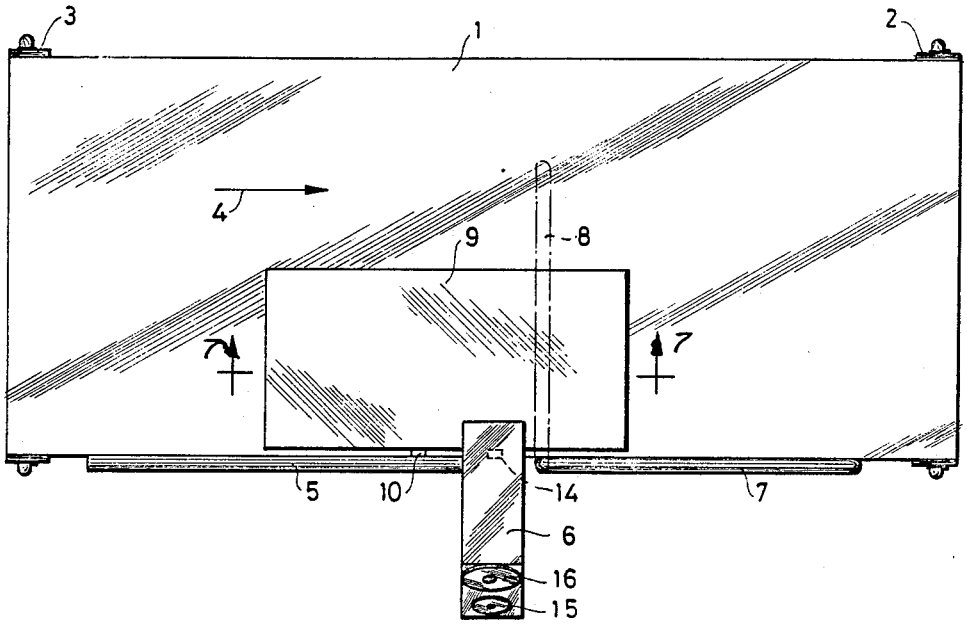
FIG. 1 shows the top view of a sewing device for mattresses according to the invention.

The sewing device shown in FIG. 1 has a supporting face in the form of an endless conveyor belt 1, running round pulleys 2, 3. The conveyance direction is indicated by arrow 4. Beside the conveyor belt 1 is the guide strip 5, above which is the sewing machine 6. A swingable arm 7 is provided beyond the sewing machine in the direction of conveyance and can be swung to the position 8 shown by broken lines. On the conveyor belt is a mattress 9 whose material covering 30 (FIG. 7) or its top face is sewn by the sewing machine 6 to the material covering its side face. Reference number 10 shows the third sensor, which detects a hindmost mattress corner in the direction of conveyance of the conveyor belt, for the purpose of slowing down the supply speed of the conveyor device and the sewing speed of the sewing device.

Figure 2:
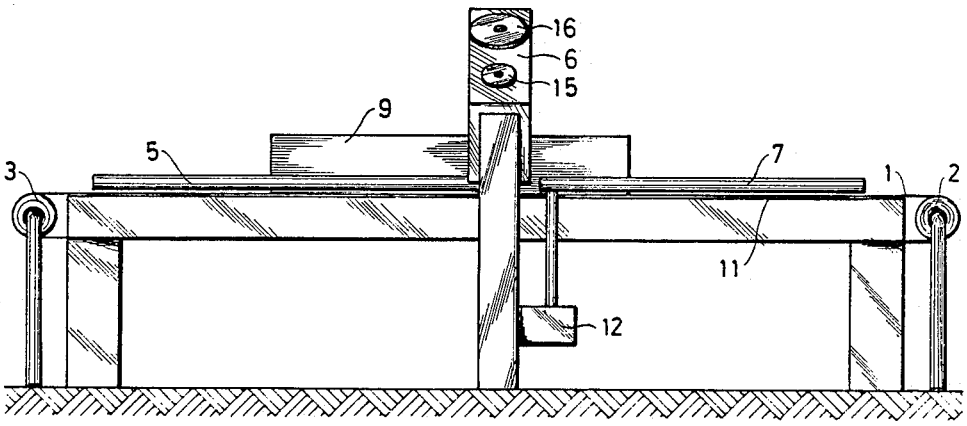
FIG. 2 shows a side view of the device of FIG. 1.
Figure 3:
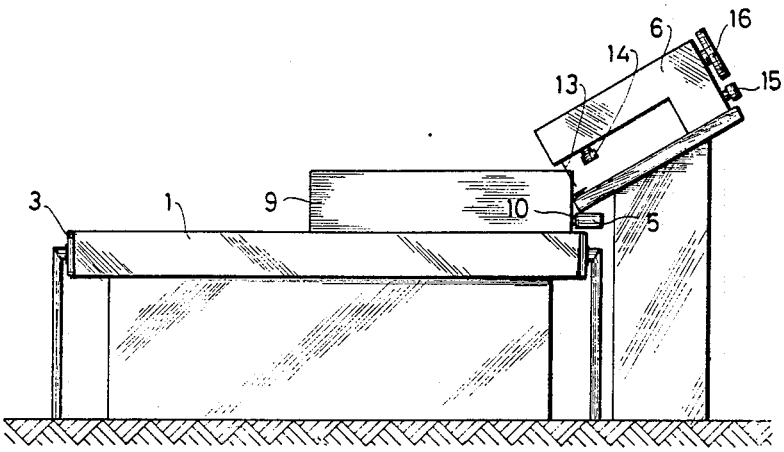
FIG. 3 shows a front view of the sewing device according to FIG. 1.

FIG. 2 shows that the top part of the conveyor belt 1 is supported by a smooth supporting plate 11. It also shows the swing mechanism 12 of the swingable arm 7, which can be, for example, a double-acting air cylinder. FIG. 3 shows that the sewing needle 13 of the sewing machine runs at an angle, in such a way that it can sew through the material on the top face of the mattress and the material on the side face of the mattress. For the sake of clarity, further details, such as the guide element for feeding in the covering strip for the sewing seam, are left out. What is shown is the first sensor 14, which detects the above-mentioned mattress corner for the purpose of stopping the drive units of conveyor belt and sewing machine, and operating the swingable arm for turning the mattress through 90° on the conveyor belt. The second sensor 15, by means of which the position of the needle 13 can be detected from the position of the drive wheel of the sewing machine 16, is also shown. The sensor 15 can also be placed elsewhere, for example at the needle. On detection of a mattress corner by sensor 14, said sensor 15 ensures that the sewing needle 13 remains in the extended position, so that when the swingable arm 7 comes into operation the mattress 9 is turned round the sewing needle 13 through 90° on the conveyor belt 1. After this, the swingable arm 7 returns automatically, and the next mattress edge can be sewn, following which the above-described actions are repeated.

Figure 4:
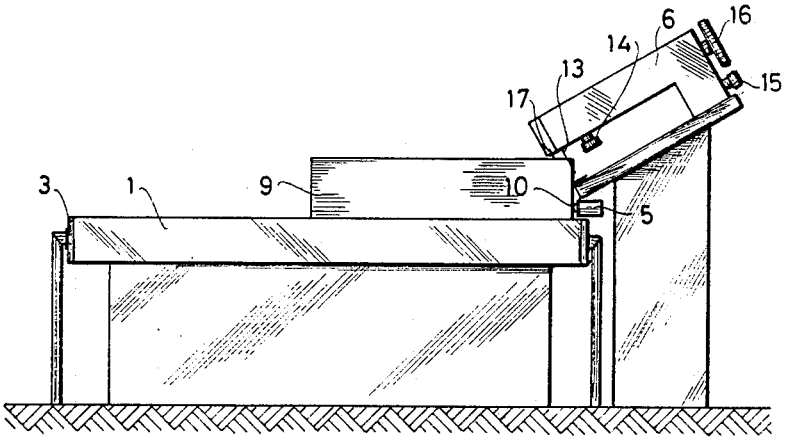
FIG. 4 shows a front view corresponding to FIG. 3 of a second embodiment of the sewing device.

FIG. 4 shows a second embodiment, in which an auxiliary needle 17 is used as the holding means for the mattress. In this embodiment, when a mattress corner has been detected by the sensor 14 the sewing needle 13 is stopped in the retracted position by means of the second sensor 15. The auxiliary needle 17 is then extended so that it penetrates into the mattress, and the swingable arm 7 is operated, so that the mattress turns around this auxiliary needle. Since the auxiliary needle is right next to the sewing needle, the next mattress edge can still be sewn further joining onto from the previous seam.

Figure 5:
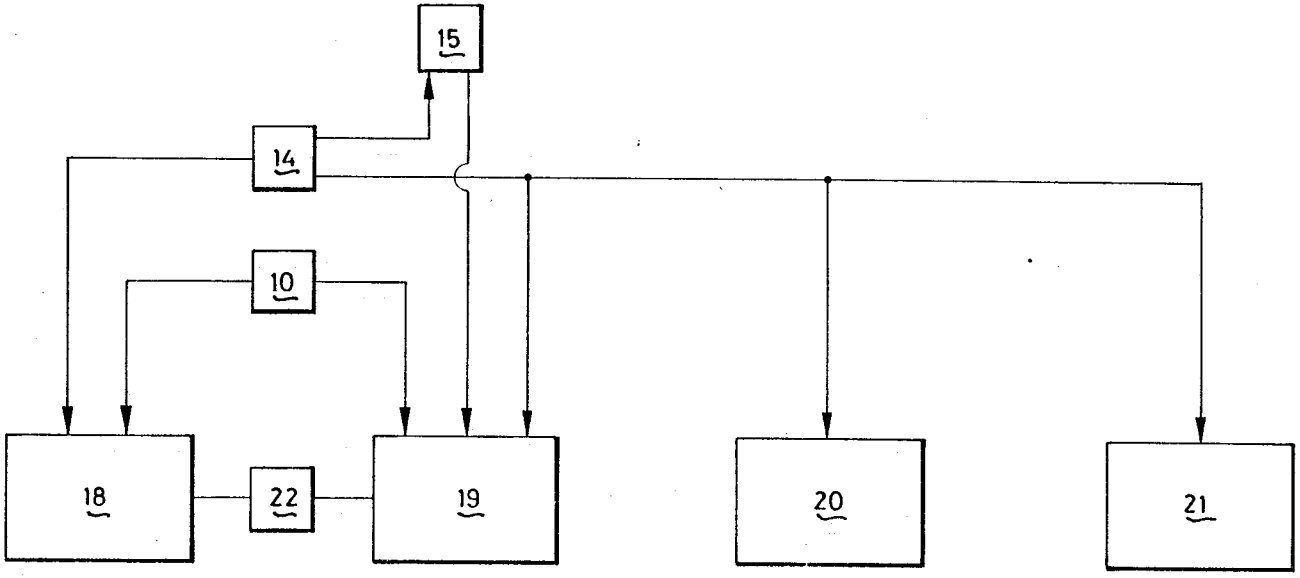
FIG. 5 shows a block diagram of the control device of the sewing device.

FIG. 5 shows the block diagram of the control device belonging to the sewing device shown in FIG. 4. The first sensor 14 is connected here to the drive units 18, 19, 20 and 21 of the conveyor belt, the sewing machine, the swingable arm and the auxiliary needle respectively. As soon as this first sensor 14 detects a hindmost mattress corner in the direction of conveyance of the conveyor belt 1, the drive units 18, 19 are switched off, and the drive units 20, 21 are switched on. The second sensor 15 for detection of the position of the sewing needle 13 is actuated and ensures that the drive unit 19 of the sewing machine is stopped at such a position that the sewing needle 13 is in the retracted position. If the auxiliary needle is very close to the sewing needle, the latter need not be retracted fully. In this way the mattress can easily be swung round the extended auxiliary needle 17. The drive unit 18 for the belt and the drive unit 19 of the sewing machine can also be connected to the third sensor 10, which ensures that the two drive units are slowed down when it detects the above-mentioned mattress corner. Finally, these drive units 18, 19 of the belt and the sewing machine are also connected by a synchronization device 22, by means of which the mutual conveyance speeds of these drive units can be synchronized for conveying the mattress to be treated along the sewing machine in the correct manner.

Figures 6, 7:
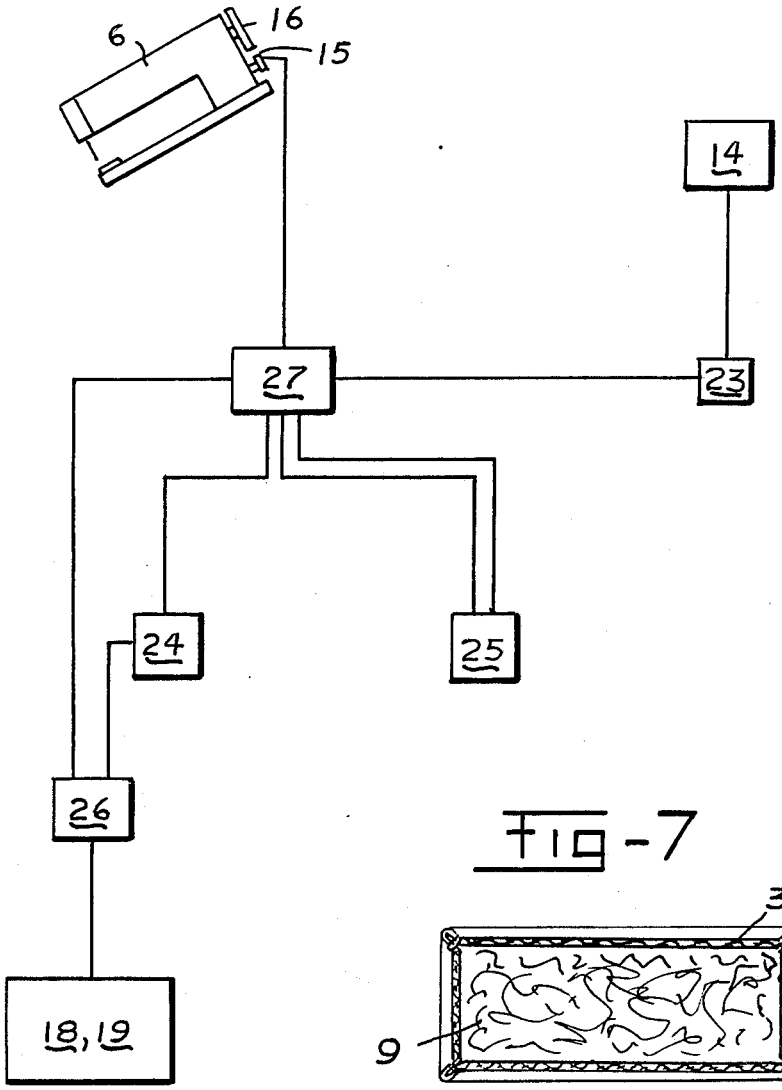
FIG. 6 illustrates in block diagram form the control device embodying the means to sew the mattress edge without overlap.
FIG. 7 is a cross-sectional view taken along line 7—7 of FIG. 1 to illustrate the cover material.

FIG. 6 shows the block diagram for automatically operating the sewing machine in such a way that the mattress edge can be sewn completely without any overlap of the sewn edges. To this end, the sensor 15 is used for counting the number of stitches. Every time that the needle completes a sewing stitch, the sensor 15 delivers a signal to the counting device 27 which is able to add or subtract each stitch signal delivered by sensor 15.

The first sensor 14, detecting a hindmost mattress corner in the direction of conveyance of the conveyor belt 1, is connected to counting device 23 in such a way that the hindmost corners detected by sensor 14, are counted in counting device 23. This counting device 23 is connected to counting device 27 for the number of stitches, for the reasons explained below.

When the sewing operation is started at a random spot on one of the mattress edges, the counter 27 counts the number of stitches by adding up, from the first stitch onwards. As soon as the first hindmost mattress corner is detected by sensor 14, counting device 23 sends a signal to counting device 27, indicating that the first hindmost corner of the mattress has been reached. At that moment, the counting device 27 stops counting the number of stitches, sends the total number of stitches between the start of the sewing operation and the first hindmost corner to the first memory element 24, and is reset.

Thereafter, the sewing operation continues until sensor 14 detects the second hindmost corner of the mattress. The second corner is counted in counting device 23, which thereupon sends a signal to counting device 27 that the second hindmost corner has been reached. Upon this signal, counting device 27 starts, beginning with 0, counting the number of stitches again. The counting operation continues until sensor 14 senses the third hindmost corner. This third corner is counted in counting device 23, which sends a signal to counting device 27 whereupon the counting operation is stopped. The total number of stitches between the second and the third corner of the mattress now is fed to second memory element 25. Preferably, this second memory element 25 is an integral part of the counting device 27.

The sewing operation is now continued between the third and the fourth corner. As soon as the fourth hindmost corner has been detected by sensor 14, this corner is counted in counting device 23. Counting device 23 thereupon sends a signal to counting device 27, which now starts subtracting each stitch from the total number of stitches stored in second memory element 25. The number of stitches resulting from this subtraction is now continuously sent to element 26, for comparing the number of stitches resulting from the subtraction, with the number of stitches stored in first memory element 24. As soon as these numbers of stitches equal each other, the element 26 sends a signal to the drive units 18, 19 of respectively the conveyor belt and the sewing machine, for stopping the devices. At that point a complete mattress edge has been sewn, without any overlap.

Alternatively, instead of counting the number of stitches, time units may be counted. According to an alternative embodiment therefore, device 27 is a timer in which time units may be added or subtracted. The counting of time units is triggered upon carrying out the first stitch, by means of sensor 15. Thereafter, the timer 27 is triggered by counting device 23, upon detection of a first hindmost corner, so as to stop counting time-units.

As in the previous embodiment, the number of time units counted is fed to first memory element 24, and the timer 27 is reset. Following this, the number of time units between the second and the third mattress corner is counted, the total number being stored in second memory element 25.

Finally, the number of time units counted after the fourth mattress corner is subtracted from the total number stored in second memory element 25. As soon as comparator element 26 detects that the result of this subtraction is equal to the number of time units stored in first memory element 24, a stop-signal is emitted.

I claim:

1. Device for sewing with a sewing needle, along the edges of a mattress or cushion, cover material covering the top and bottom of the mattress to cover material covering the sides of the mattress, comprising supporting face means which is movable for moving the mattress relative to said sewing needle, said sewing needle adapted to be pushed through the cover material which covers the edge area of the top or bottom of the mattress and the cover material which covers the adjacent edge area of the side of the mattress, which mattress is resting on said supporting face means, a swingable arm adapted to be swung between a position parallel to and a position essentially perpendicular to the direction of movement of said supporting face means, whereby, in the latter position, at least the part of said arm near the swivel point is lying beyond said sewing needle in the direction of movement of said supporting face means, first sensor means located near the swivel point for detecting a hindmost mattress corner in the direction of movement of said supporting face means, and holding means for holding the mattress at said corner; said sensor means and the drive units for said sewing needle, said supporting face means, said holding means and said swingable arm being connected to a control device means for stopping said sewing needle and said supporting face means on detection of a mattress corner and for bringing said holding means and said swingable arm into said operating position so that the mattress can be swung about the held corner, and means for subsequently returning said holding means and said arm to the idle position again.

2. Device according to claim 1, characterized in that provision is made for a second sensor for detecting the position of the needle, said sensor being connected to the control device in such a way that on detection of the said mattress corner by the first sensor the needle can be stopped in the extended position and in that position constitutes the holding means for the turning of the mattress.

3. Device according to claim 1, characterized in that the holding means are an extendible and retractable auxiliary needle near the sewing needle, and a second sensor is provided to detect the position of the sewing needle connected to the control device, in such a way that on detection of the said mattress corner by the first sensor the sewing needle can stopped in the retracted position and the auxiliary needle can be brought into the extended position.

4. Device according to claim 1, characterized in that, there is a third sensor in the direction of movement of the mattress before the sewing machine, which sensor is connected in such a way to the control device that the driving speed of the drive units of sewing machine and supporting face can be reduced gradually on detection of the mattress corner.

5. Device according to claim 1, characterized in that the drive units of the supporting face and the sewing machine are coupled by a synchronization device for synchronization of said drive units in such a way that the mattress can be moved in a straight line along the sewing machine.

6. Device according to any of claims 1–5, characterized in that it is provided with a first memory element for storage of a first number of stitches, a second memory element for storage of a second number of stitches, a counting device for counting the corners detected by the first sensor, a counting device for adding or subtracting the stitches for counting the first number of stitches between the first stitch and the first corner, for counting the second number of stitches between the second and the third corner, and for subtracting the stitches from the second number of stitches after detection of the fourth corner, and an element connected to the drive units for comparison of the first and second number and for stopping the drive units if the second number has become equal to or smaller than the first number.

7. Device according to any of claims 1 to 5, characterized in that it is provided with a first memory element for storing a first number of time units, a second memory element for storing a second number of time units, a counting device for counting the corners detected by the first sensor, a counting device for adding or subtracting the time units for counting the first number of time units between the first stitch and the first corner, for counting the second number of time units between the second and the third corner, and for subtracting the time units from the second number of time units after detection of the fourth corner, and an element connected to the drive units for comparing the first and second number and for stopping the drive units if the second number has become equal to or less than the first number.

8. Device for sewing the edges of a mattress in which material for covering the mattress and the mattress are dispensed to the needle of a sewing machine for sewing the cover material which covers the top and bottom surfaces of said mattress to material covering the side surfaces of said mattress, said device comprising: movable supporting face means for moving said mattress relative to said sewing machine by which the sewing needle is pushed through the material covering the edge area of the top or bottom of the mattress and the material which covers the adjacent edge of the side of said mattress, a swingable arm adapted to be swung about a swivel point, said swingable arm being disposed in the direction of movement of said mattress and operable between a first position parallel to said direction of movement and a second position substantially perpendicular to the direction of movement, whereby, in the second position, at least the part of said arm near the swivel point is lying beyond said sewing needle in said direction of movement of said supporting face means, first sensor means adjacent to said swivel point of said arm for sensing the presence of the hindmost corner of said mattress in said direction of movement of said supporting face means, holding means for holding said mattress at said corner, second sensor means operative upon detection of said hindmost corner of said mattress by said first sensor means for stopping said sewing needle in the extended position within said material thereby holding said mattress in position for being rotated, control device means operatively connected to said sewing machine, said supporting face means, said second sensor means, and said arm for stopping said sewing machine upon detection of said corner and for operating said arm to said second position thereof whereby said mattress is rotated substantially 90 degrees about the held corner, and means for subsequently returning said arm to said first position thereof at the conclusion of said rotation of said mattress whereby the commencement of the sewing operation is resumed.

9. Device for sewing with a sewing needle, along the edges of a mattress or cushion, cover material covering the top and bottom of the mattress to cover material covering the sides of the mattress, comprising supporting face means which is movable for moving the mattress relative to said sewing needle, said sewing needle adapted to be pushed through the cover material which covers the edge area of the top or bottom of the mattress and the cover material which covers the adjacent edge area of the side of the mattress, which mattress is resting on said supporting face means, a swingable arm adapted to be swung about a swivel point between a position parallel to and a position essentially perpendicular to the direction of movement of said supporting face means, whereby, in the latter position, at least the part of said arm near the swivel point is lying beyond said sewing needle in the direction of movement of said supporting face means, first sensor means located near the swivel point for detecting a hindmost mattress corner in the direction of movement of said supporting face means, and holding means for holding the mattress; said sensor means and the drive units for said sewing needle, said supporting face means, said holding means and said swingable arm being connected to a control device means for changing the sewing speed and the speed of movement of, respectively, said sewing needle and said supporting face means on detection of a corner and for bringing said holding means and said swingable arm into said operating position so that the mattress can be swung, and means for subsequently returning said holding means and said arm to the idle position again.

* * * * *